United States Patent [19]

Yerke

[11] 4,012,039

[45] Mar. 15, 1977

[54] PERMANENT FORM-FITTING, NON-SLIP COVER FOR HANDGRIPPING PORTION OF BASEBALL BATS, GOLF CLUBS AND THE LIKE

[75] Inventor: Herman Yerke, Largo, Fla.

[73] Assignee: Joe Hall, Jr., Clearwater, Fla.

[22] Filed: July 22, 1974

[21] Appl. No.: 490,778

Related U.S. Application Data

[63] Continuation-in-part of Ser. No. 379,200, July 13, 1973, abandoned.

[52] U.S. Cl. ..... 273/72 R; 273/75; 273/81 R

[51] Int. Cl.[2] ..... A63B 59/06; A63B 53/14

[58] Field of Search ..... 273/67 R, 67 A, 68, 273/72 R, 73 J, 75, 81 R, 81 B, 67 DA; 74/551.1, 551.8, 551.9, 552, 557, 563, 558, 558.5; 145/61 R; 16/110 R; 427/196, 197, 200, 201; 46/DIG. 1

[56] References Cited

UNITED STATES PATENTS

| | | | |
|---|---|---|---|
| 300,360 | 6/1884 | Gray | 273/72 R |
| 2,002,535 | 5/1935 | Gagnier | 273/81 R |
| 2,121,963 | 6/1938 | Goit | 273/81 R UX |
| 3,128,514 | 4/1964 | Parker et al. | 46/DIG. 1 |
| 3,129,003 | 4/1964 | Mueller et al. | 273/72 R |
| 3,266,804 | 8/1966 | Carter | 46/DIG. 1 |
| 3,368,811 | 2/1968 | Finney | 273/75 X |
| 3,436,245 | 4/1969 | Grundman | 117/25 |
| 3,453,132 | 7/1969 | Frankland | 117/26 X |
| 3,458,194 | 7/1969 | Coles | 273/67 A |
| 3,765,922 | 10/1972 | Chisholm | 427/200 |

FOREIGN PATENTS OR APPLICATIONS

| | | | |
|---|---|---|---|
| 778,735 | 2/1968 | Canada | 427/200 |

*Primary Examiner*—Richard J. Apley

[57] ABSTRACT

A permanent form fitting slip resistant covering for the hand gripping portion of a baseball bat or similar sporting or non-sporting device. The covering is a synthetic fiber that is applied to the handle by means of an Electrostatic machine or any other flocking device using an epoxy, or similar base glue. The fibers can be applied to any type of matter that constitutes the hand-gripping portion of the device: i.e.: wood, steel, aluminum, et cetera.

1 Claim, 4 Drawing Figures

PERMANENT FORM-FITTING, NON-SLIP COVER FOR HANDGRIPPING PORTION OF BASEBALL BATS, GOLF CLUBS AND THE LIKE

This application is a continuation-in-part of my presently co-pending application Ser. No. 379,200, filed July 13, 1973 and now abandoned.

BACKGROUND OF THE INVENTION

1. Field of the Invention

This invention pertains to a new and novel fiber coating for the hand-gripping portion of the baseball bat or similar device, sporting and non-sporting.

SUMMARY OF THE INVENTION

It is of primary importance that the hand-gripping portion of such a device of any character be provided with a permanent form fitting slip-resistant covering of a suitable fibrous material and that the same be actually welded to the hand-gripping portion of the baseball bat or other device, after the same has been provided with an epoxy or similar glue base with an electrostatic machine or other flocking device.

An important object of the invention is to provide a slip-resistant fiberous covering for the hand-gripping portion of a baseball bat or other device that will be permanent and non-slipping as well as moisture proof.

A further object of the invention is to provide a permanent covering, of a fibrous material to the glued portion of a device, whether to a baseball bat, racquet handle or to the handle of any other device, of which there are many, and too numerous to mention in this application.

A still further object of this invention is to provide a form fitting, slip-resistant covering for baseball bats and handles of other sporting goods devices and the handles of non-sporting goods devices such as shovels, pitchforks and the like.

Other objects and advantages of the invention will be apparent during the course of the following description.

In the accompanying drawings, forming a part of the application, like numerals of reference are employed to designate like parts.

The invention accordingly comprises the features of construction, combination of elements and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION

Figures 1, 2, 3:
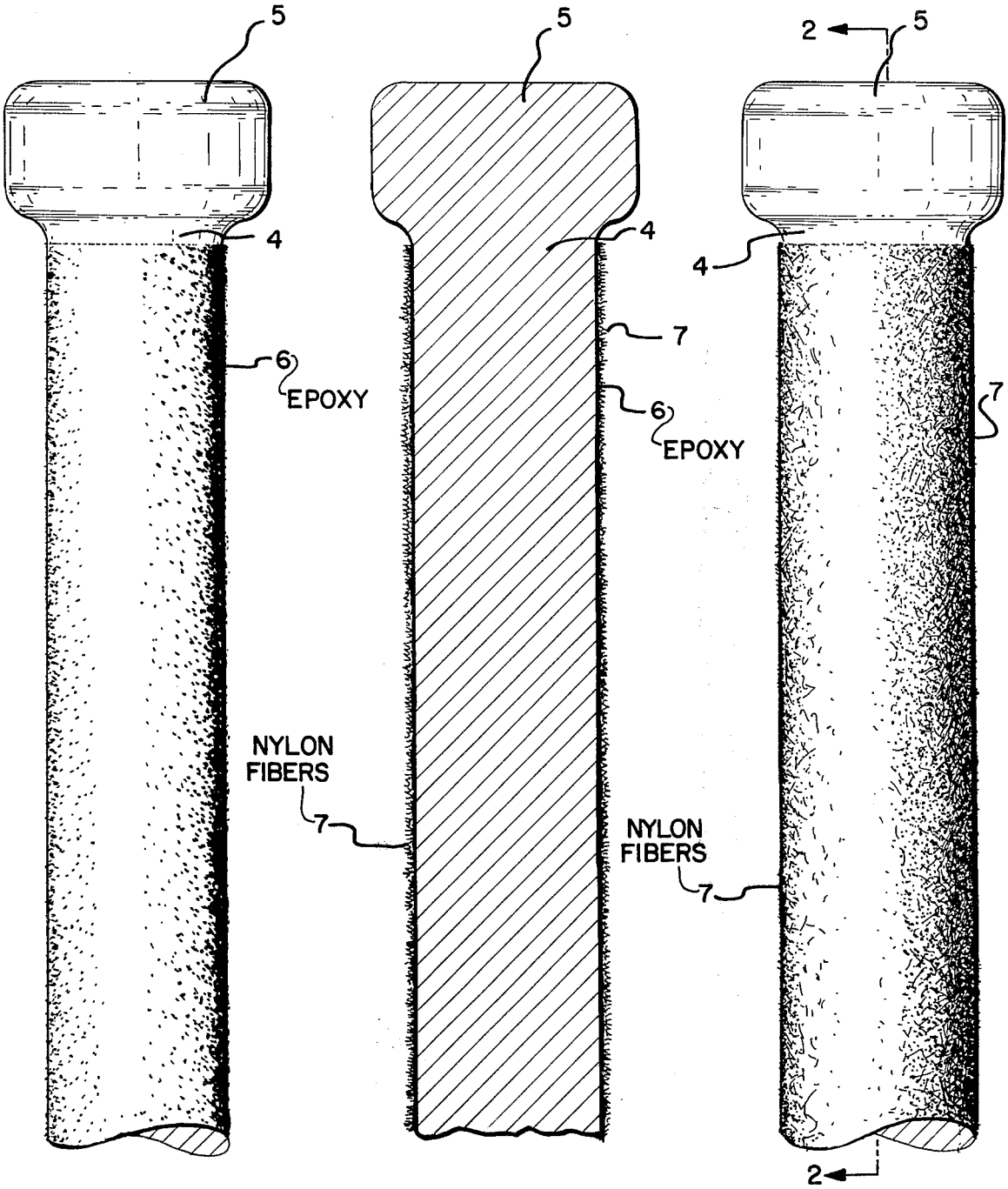
FIG. 1 is an elevational view of a baseball bat having an epoxy or similar glue applied thereto.
FIG. 2 is a vertically disposed sectional view of FIG. 3.
FIG. 3 is a vertically elevational view of the baseball bat with the synthetic fibers applied to the glue base.
Figure 4:
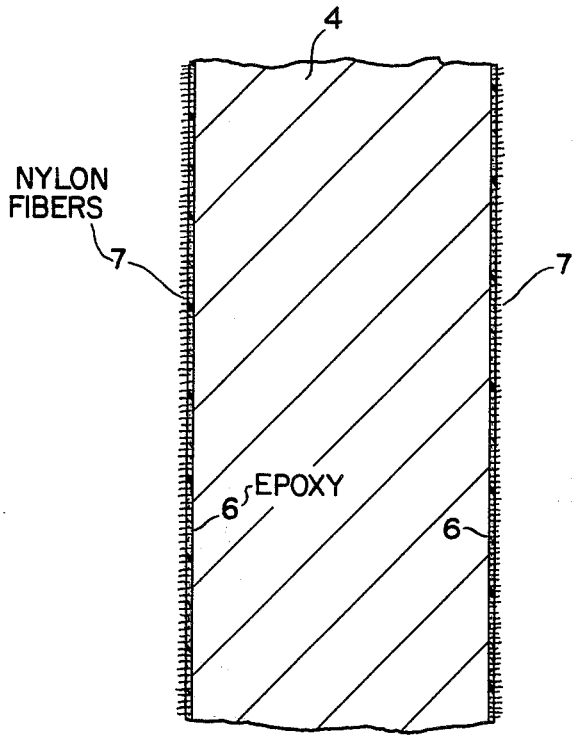
FIG. 4 is a detailed sectional view similar to that of FIG. 2.

In the drawings, wherein for the purpose of illustration, is shown a preferred embodiment of my invention, in that numeral 4 designates the cross section of the hand-gripping portion of a baseball bat or the like which is usually circular. The hand-gripping portion 4 is provided with the usual head 5 if it is a baseball bat, in other sporting goods or non-sporting devices the head 5 can be completely eliminated as with golf clubs, canes and the like. The cylindrical surface of the hand-gripping portion of a baseball bat or the like is coated with epoxy or any suitable glue designated 6.

A nylon or other synthetic fiber material designated 7 30 to 90 mils in length can be applied to a glue base 6 with an electrostatic machine or any other flocking device to provide a permanent form fitting slip-resistant covering for the hand-gripping portion of a baseball bat or the like. Because the fibers are electrostatically applied, one end thereof adheres to the handle while the other end extends outwardly therefrom. The synthetic fiber material 7 when applied to the handle of the baseball bat or the like is permanent, non-slipping, and non-perspiration absorbing. However, the fibrous coated surface of the hand-gripping portion of a baseball bat or the like can be washed off with soap and water when it gets dirty.

While FIG. 2 shows the use of epoxy and nylon fibers, it is to be understood that any suitable adhesive and fiber may be used in the structure of the present invention.

It is to be understood that the form of my invention, herewith shown and described, is to be a preferred example of the same, and that various changes in the synthetic material, in the shape of the same, size and arrangement of the parts therefore may be resorted to without departing from the spirit of the appended claims.

It will thus be seen that the objects made apparent from the preceding description, are efficiently attained and since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. In combination with a baseball bat having a hand-gripping portion, a slip-resistant cover for said hand-gripping portion, said cover comprising:

a coating of epoxy of substantially uniform thickness disposed in surrounding relation to said hand-gripping portion of the baseball bat;

said coating of epoxy being directly applied to said hand-gripping portion of the baseball bat;

a plurality of nylon fibers having longitudinal dimensions between 30 and 90 mils;

one end of each of said plurality of said fibers being directly imbedded in said coating of epoxy on the hand-gripping portion of the baseball bat;

the other end of each of said plurality of said fibers extending outwardly from said coating of epoxy on the hand-gripping portion of the baseball bat, and said plurality of said fibers covering substantially the entire exposed surface of said coating of epoxy on the hand-gripping portion of the baseball bat.

* * * * *